US006860282B2

(12) United States Patent
Guler

(10) Patent No.: US 6,860,282 B2
(45) Date of Patent: Mar. 1, 2005

(54) SYSTEM AND METHOD FOR CONVERTING MANUALLY-OPERATED FLUSH VALVE

(75) Inventor: Fatih Guler, Winchester, MA (US)

(73) Assignee: Arichell Technologies, Inc., West Newton, MA (US)

( * ) Notice: Subject to any disclaimer, the term of this patent is extended or adjusted under 35 U.S.C. 154(b) by 100 days.

(21) Appl. No.: 09/972,496

(22) Filed: Oct. 6, 2001

(65) Prior Publication Data

US 2003/0066125 A1 Apr. 10, 2003

(51) Int. Cl.[7] ..... F16K 31/05

(52) U.S. Cl. ..... 137/1; 137/269; 251/129.04; 4/249; 4/DIG. 3

(58) Field of Search ..... 137/1, 269; 251/129.04; 4/623, 304, 305, 405, 406, DIG. 3, 249

(56) References Cited

U.S. PATENT DOCUMENTS

| | | | | |
|---|---|---|---|---|
| 2,552,625 A | * | 5/1951 | Filiung, Jr. | 137/624.12 |
| 2,999,191 A | | 9/1961 | Muradian et al. | |
| 3,019,453 A | | 2/1962 | Radcliffe | |
| 3,056,143 A | * | 10/1962 | Foster | 4/249 |
| 3,373,449 A | | 3/1968 | Rusnok | |
| 3,778,023 A | | 12/1973 | Billeter | |
| 4,604,735 A | | 8/1986 | Parsons | |
| 4,839,039 A | | 6/1989 | Parsons et al. | |
| 4,847,924 A | * | 7/1989 | Samaniego | 4/308 |
| 4,921,211 A | | 5/1990 | Novak et al. | |
| 5,062,453 A | * | 11/1991 | Saadi et al. | 137/624.11 |
| 5,125,621 A | | 6/1992 | Parsons et al. | |
| 5,169,118 A | | 12/1992 | Whiteside | |
| 5,195,720 A | | 3/1993 | Nortier et al. | |
| 5,224,685 A | | 7/1993 | Chiang et al. | |
| 5,244,179 A | | 9/1993 | Wilson | |
| 5,251,188 A | | 10/1993 | Parsons et al. | |
| 5,251,872 A | * | 10/1993 | Kodaira | 251/129.04 |
| 5,295,655 A | | 3/1994 | Wilson et al. | |
| 5,313,673 A | | 5/1994 | Saadi et al. | |
| 5,431,181 A | | 7/1995 | Saadi et al. | |
| 5,456,279 A | | 10/1995 | Parsons et al. | |
| 5,680,879 A | | 10/1997 | Sheih et al. | |
| 5,870,015 A | * | 2/1999 | Hinkel | 4/661 |
| 5,881,993 A | | 3/1999 | Wilson et al. | |
| 5,979,500 A | | 11/1999 | Jahrling et al. | |
| 5,984,262 A | | 11/1999 | Parsons et al. | |
| 6,000,674 A | | 12/1999 | Cheng | |
| 6,056,261 A | | 5/2000 | Aparicio et al. | |
| 6,127,671 A | | 10/2000 | Parsons et al. | |
| 6,161,726 A | | 12/2000 | Parsons et al. | |
| 6,212,697 B1 | | 4/2001 | Parsons et al. | |
| 6,216,730 B1 | | 4/2001 | Hall | |
| 6,293,516 B1 | | 9/2001 | Parsons et al. | |
| 6,299,127 B1 | | 10/2001 | Wilson | |
| 6,305,662 B1 | | 10/2001 | Parsons et al. | |
| 6,643,853 B2 | * | 11/2003 | Wilson et al. | 4/249 |
| 2003/0116736 A1 | * | 6/2003 | Muderlak | 251/129.04 |

FOREIGN PATENT DOCUMENTS

| | | |
|---|---|---|
| WO | WO91/17380 | 11/1991 |
| WO | WO01/29464 | 4/2001 |

* cited by examiner

*Primary Examiner*—Kevin Lee
(74) *Attorney, Agent, or Firm*—Ivan D. Zitkovsky

(57) ABSTRACT

Disclosed is a method and system for converting or retrofitting manually operated flush valves. A conversion system for converting an installed manually-operated flush valve includes a power module, a control module, and a driver module mechanically coupled to a displacement member arranged to externally activate the converted flush valve.

53 Claims, 9 Drawing Sheets

SYSTEM AND METHOD FOR CONVERTING MANUALLY-OPERATED FLUSH VALVE

BACKGROUND

The present invention relates to a method and system for converting or retrofitting manually operated, already installed flush valves.

In toilet rooms it is common to use various types of flushing systems for flushing urinals or toilet bowls (also commonly referred to as toilets). A first type of a conventional toilet flush system uses water accumulated in a water storage tank. This system usually includes a float operated intake valve mounted at a water intake pipe for delivering water into the water tank. The intake valve includes a rod connected to a float that acts to close the intake valve when there is a predefined water level in the water tank. At the bottom of the water tank, there is a tank outlet fixture through which water from the tank is discharged into a toilet bowl when a flush handle is activated to flush the toilet. During and after the flushing action, the float drops below a closing position, which in turn opens the intake valve and water flows into the tank until water in the tank reaches the predefined level. At the predefined level, the float floats up to the closing position that in turn closes the intake valve.

A second type of a conventional toilet flush system doesn't use the water storage tank, but uses water for flushing directly from a water supply line. This flush system uses a flush valve (known as a "Flushometer") that may be a diaphragm-type valve or a piston-type valve. The flush valve can be manually activated by depressing a handle (or can be automatically activated by a sensor) to control flushing a toilet or a urinal. In these systems the flush valve controls a pilot section that is located somewhat above the diaphragm (in the valve diaphragm-type valve) or the piston (in the piston-type valve). The pilot section receives water through one or several control orifices. The valve controls pressure in the pilot section, which in turn activates water flow from the supply line to the toilet or urinal creating the flush action.

In the diaphragm-type valve or the piston-type valve, the pilot section has the control orifices with a quasi-fixed supply rate by virtue of maintaining a hydraulic condition known as "choked flow condition". The pilot section also includes a drain valve, which is activated by the user handle to lower pressure in the pilot section. Upon activation of the drain valve (which has a flow through rate much higher than the control orifice feed rate), the pilot chamber is depleted, resulting in the opening of the main flow passage that facilitates the main flushing flow. The main passage will remain open as long as it takes for the pilot chamber to refill (after handle release followed by drain valve reseal) through the pilot orifice. The water pressure in the pilot chamber closes the main passage to seal the main water dosage, as described in detail in connection with FIG. 1.

The diaphragm-type flush valves and the piston-type flush valve were described in numerous publications and patents. For example, various diaphragm-type flush valves are described in U.S. Pat. Nos. 5,125,621; 5,456,279; 6,216,730; or PCT publication WO91/17380, and the piston-type flush valve is described in U.S. Pat. No. 5,881,993.

FIG. 1 shows a prior art diaphragm-type flush valve for flushing a toilet or a urinal. Flush valve 10 includes a diaphragm 12 disposed on a valve seat 14 formed on a lower part 16 of the valve body. The valve body also includes an upper body part 18 with a dome or cap 20 that clamps diaphragm 12 against lower body part 16 using an upper housing 22. In the closed position, water has entered by an inlet pipe 24 into an annular main chamber 26 surrounding a cylindrical inner wall 30 of lower body part 16. The sealing action of diaphragm 12 prevents water in main chamber 26 from flowing from main chamber 26 into an outlet conduit 32. That is, diaphragm 12 seals main passage 14 in the closed position.

Flush valve 10 includes a pilot chamber 36 formed by the dome 20 and diaphragm 12. Diaphragm 12 includes a control orifice 34, which enables water flow from main chamber 26 to pilot chamber 36 and thus causes pressure equalization between main chamber 26 and pilot chamber 36 separated by diaphragm 12. When the pressure is equalized, there is a net force on diaphragm 12 from pilot chamber 36 downward (on the diaphragm 12) since the diaphragm area in pilot chamber 36 is larger than the opposing diaphragm area in main chamber 26. The downward oriented net force keeps the valve closed by sealing main passage 14. To open flush valve 10, a pilot valve provides a pressure-relief mechanism that lowers the water pressure in pilot chamber 36. The pilot valve includes a pilot valve member 50 with a rod portion 58 displaceable by a plunger 56 connected to a manual flush handle 54. Pilot valve member 50 includes a pilot seat 52 for sealing against in the diaphragm plate 38.

Operation of handle 54 causes displacement of plunger 56 against rod portion 58 of pilot valve member 50. When pilot valve member 50 is displaced, water flows with minimal flow resistance from pilot chamber 36 near pilot seat 52 through the relief opening 49, while control orifice 34 in the diaphragm plate 38 imposes considerable resistance to the compensating flow from main chamber 26 through orifice 34 to pilot chamber 36. Consequently, the pressure in pilot chamber 36 decreases significantly below the pressure in main chamber 26 so that the force exerted by pressure in pilot chamber 36 is lower than that exerted by the pressure in main chamber 26. Thus, the portion of the diaphragm plate 38 located interior to its clamped portion 59 flexes upward, rising off main valve seat 14 (i.e., main passage 14); this opens the valve and water flows from main chamber 26 to water output 32.

When a user releases flush handle 54, pilot valve 50 returns to its position on pilot valve seat 52, but the pressure in the pilot chamber 36 does not immediately return to the level in the main chamber 26 because the pressure-equalizing flow from main chamber 26 to pilot chamber 36 is restricted by the small size of control orifice 34. This delay in pressure equalization is desirable because for a predetermined length of time water flows from output 32 to the connected toilet or urinal. Ultimately, however, the water flow via control orifice 34 equalizes the pressure between main chamber 26 and pilot chamber 36 to the point at which the downward force on main diaphragm 12 overcomes the upward force, and the valve closes. This entire flushing cycle is repeated by moving handle 54.

There are several existing design approaches used for converting (i.e., retrofitting) the existing manual flush valves to sensory-activated electronically controlled automatic valves. There is a top cover assembly that replaces upper housing 22 (shown in FIG. 1). The top cover system includes an electronic sensory module, a battery pack, and electronics for controlling a bi-stable solenoid that acts upon a pilot valve. The pilot valve in turn controls the main diaphragm valve. The top cover conversion system usually includes a new main diaphragm assembly that replaces main diaphragm 12 (used in the manual system shown in FIG. 1). These types of conversion systems are described in U.S. Pat. Nos. 5,169,118 and 5,244,179.

Another type of a sensory controlled flushing device (known as a "side mount" conversion device) is described, for example, in U.S. Pat. Nos. 5,431,181, 5,680,879 and 6,056,261. The side mount device includes a sensory module, a battery pack, an electric motor, and an activation plunger that is mounted onto a common housing. Specifically, in the "side mount" device, the activation plunger is mounted on to the flush valve assembly after first removing a manual handle (e.g., flush handle 54 in FIG. 1). Upon receiving a flush command from the sensory module, the electronics activates the movement of the replacement plunger thereby activating the pilot valve, which in turn starts the flush cycle.

The installation of the "side mount" conversion (retrofit) device requires removal and replacement of the manual flush handle. The handle removal frequently requires breaking the existing water seal for installation. Specifically, to install some of these devices, a person may need to turn the water supply off, dismantle portions of the flush valve, install the device, reestablish the water seal, and then turn the water back on. Perhaps, even if the water supply doesn't need to be turned off, the person needs to remove the manual flush handle. Thus, in either case, this installation requires the job to be performed by a qualified professional.

Importantly, some conversion or retrofit devices do not have a truly manual override mechanism (i.e., the ability to override the sensory control to start a flushing cycle if there is no electrical power available). These systems usually have an electrical switch that bypasses the optical sensor to trigger flushing electronically, but this cannot be done during power source failure. That is, such conversion device cannot start a flushing cycle (sensory or "manual" by depressing a switch triggering a solenoid) during power failure.

Therefore, there is still a need for devices for converting or retrofitting manually operated, already installed flush valves used in toilet rooms.

SUMMARY OF THE INVENTION

The present invention relates to a method and system for converting or retrofitting manually operated flush valves. A conversion system for converting an installed manually-operated flush valve includes a power module, a control module, and a driver module mechanically coupled to a displacement member arranged to externally activate the converted flush valve.

Preferably, the conversion system may be installed without removing any active flush valve component of the installed manual valve, or without disconnecting the water supply to the already installed flush valve. The use of the conversion system does not prevent fully manual operation (e.g., during complete power failure). That is, after conversion, the manual valve handle may still be activated by a user that triggers manually the flush cycle. This feature allows a truly manual override of the converted automatic, sensor activated flush valve during a total power failure. In the automatic mode, the conversion system uses an automatic sensor to trigger a driver module for activating the flush valve handle.

According to one aspect, the present invention includes a conversion system for converting an installed manually-operated flush valve used with a urinal or toilet. The conversion system includes a power module, a control module, and a driver module arranged for mechanical, hydraulic or other coupling to the manually-operated flush valve.

Preferred embodiments of this aspect may include one or more of the following features: The control module includes a sensor. The sensor may be an optical sensor, an ultrasonic sensor, a capacitive sensor, or any other sensor. The sensor may be constructed to detect motion near the flush valve or to detect presence near the flush valve. The sensor is preferably an infrared sensor.

The driver module includes a gear mechanism mechanically coupled to a displacement member. The displacement member includes a proximal region coupled to the gear mechanism and a distal end shaped to provide contact with the manual handle. The power module includes a battery and the driver module includes an electromotor powered by the battery and coupled to a displacement member.

According to another aspect, the invention is a conversion system for converting an installed manually-operated flush valve used with a urinal or toilet. The conversion system includes an externally mounted conversion assembly including a power module, a control module including a sensor, and a driver module mechanically coupled to a displacement member arranged to externally activate the manually-operated flush valve using a manual valve handle.

Preferred embodiments of this aspect may include one or more of the following features: The sensor may be an optical sensor or ultrasonic sensor. The sensor may be constructed to detect motion near the flush valve, or to detect presence near the flush valve. The sensor may be an infrared sensor. The displacement member includes a proximal region coupled to the gear mechanism and a distal end shaped to provide contact with the manual handle. The power module includes a battery and the driver module includes an electromotor powered by the battery and coupled to a displacement member.

Preferred embodiments of both of the above aspects may include one or more of the following features: The conversion assembly does not include any part being in direct contact with a water passage of the manually-operated flush valve. The manually-operated flush valve includes a diaphragm-type valve mechanism or a piston-type valve mechanism.

The displacement member is constructed and arranged to rotate or move linearly (or both) when acting on the manual handle. The manually operated flush valve mechanism may include a piston-type mechanism, a diaphragm-type mechanism or another related mechanism.

According to yet another aspect, a method for converting a manually operated flushometer-type valve used with a urinal or toilet, is practiced by manually flushing the valve by displacing a manual valve handle, or another installed manual actuator, to check proper operation of the valve including water flow from a water inlet to a water outlet of the valve, providing a conversion assembly including a sensor constructed to provide a signal to a control module for actuating a drive module and a displacement member, mechanically, hydraulically or otherwise coupling the displacement member to the valve handle, or to another manual actuator, triggering the sensor and thereby actuating the drive module constructed to move the displacement member, and displacing the manual valve handle, or activating the other manual actuator, by action of the displacement member and thereby initiating water flushing.

The method may further include manually displacing the handle. The method may be performed without closing a water supply to the water inlet, or without disassembling any part of the manually operated flush valve. The method may be performed without performed without removing any active part of the existing manually operated flushing system.

According to yet another aspect, a method for converting an existing manually operated flushing system, used with a urinal or toilet, to an automatic flushing system, may be performed by providing a conversion assembly including a sensor constructed to provide a signal to a control module for actuating a drive module, positioning a mechanical actuator coupled to the drive module relative to an existing manually operated handle of the flushing system, triggering the sensor and thereby actuating the drive module constructed to cause displacement of the manual handle, or another manual actuator, of the flushing system causing water flushing, wherein the providing and the coupling is performed without removing any active part of the existing manually operated flushing system.

The method may further include manually displacing the handle. The method may further include manually displacing by hand touching the manually operated handle. The method may be performed without closing a water supply to the water inlet, or without disassembling any part of the manually operated flush valve.

The displacement member may perform a substantially linear motion when displacing the manual handle to actuate the valve mechanism. The displacement member may perform a substantially rotational motion when displacing the manual handle to actuate the valve mechanism. The displacement member may perform both rotational and linear motion when displacing the manual handle to actuate the valve mechanism.

The process of fixedly mounting the conversion assembly relative to the valve body includes attaching the conversion assembly directly onto the valve body, or on a wall near the valve body, or on any suitable stationary surface near the valve body.

The drive module may include a gear mechanism coupled to the displacement member. The displacement member may include a linear structure having a proximal region coupled to the gear mechanism and a distal end shaped to provide contact with the manual handle during the pivotably displacing. The method may include operating a valve mechanism that includes a diaphragm-type valve, or a piston-type valve, or a flush valve for water tanks.

The control module includes one or even several sensors. The sensor may be any suitable sensor such as an optical sensor or an ultrasonic sensor. The sensor may sense presence or motion, or both.

DESCRIPTION OF THE PREFERRED EMBODIMENT

Figure 1:
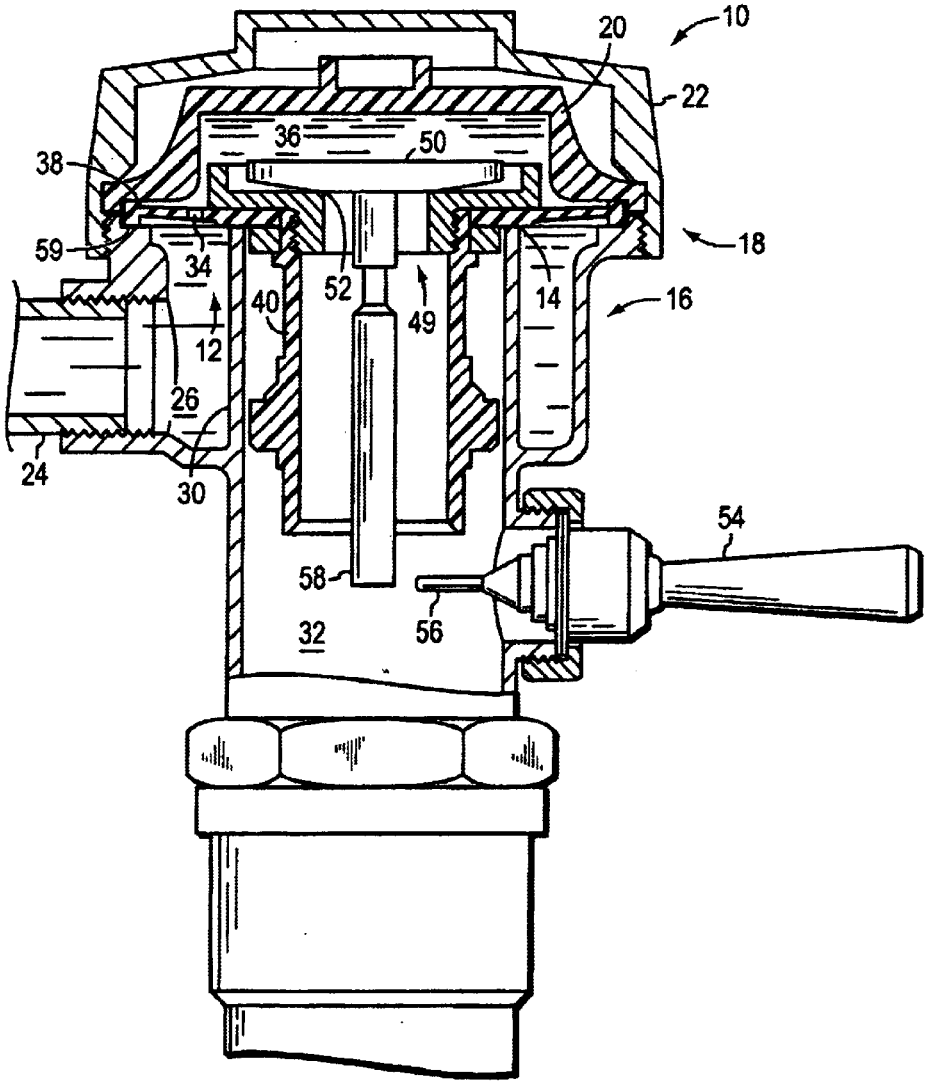
FIG. 1 (PRIOR ART)
FIG. 1 is a cross-sectional view of a diaphragm operated manual flush valve, according to prior art.
Figure 2:
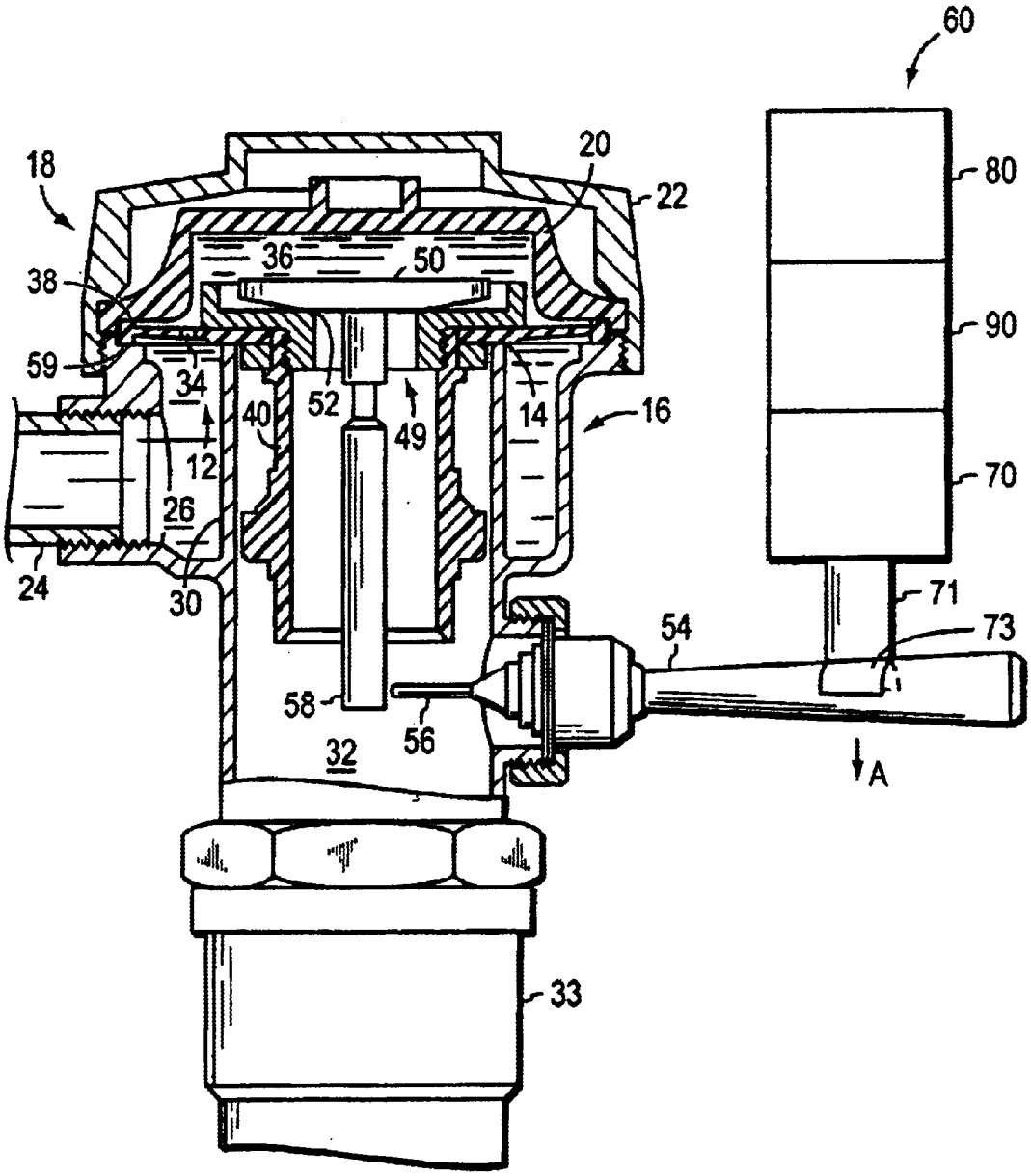
FIG. 2 depicts the diaphragm valve of FIG. 1 retrofitted for automatic operation using a conversion system shown diagrammatically in FIG. 2A.

FIG. 2 depicts a converted sensory-activated and electronically controlled Flushometer device using an existing, manual Flushometer device shown in FIG. 1. A conversion system 60 is an externally mounted conversion assembly that may be physically mounted on or attached to the Flushometer device (i.e., flush valve 10), or mounted on an adjacent wall surface, or any other fixed member located near manual flush handle 54. (FIG. 2 shows only schematically system 60 without limiting it to any specific geometric arrangement.) For example, conversion system 60 may use a housing that is rigidly clamped onto the Flushometer main body at the handle mount juncture (e.g., the handle mount shank). In general, preferably, the attachment methodology doesn't require any disassembly of any part of an installed, manual Flushometer, thereby assuring no water seal is broken during assembly. Furthermore, the attachment methodology allows easy replacement of batteries or other servicing of conversion system 60.

Figure 2A:
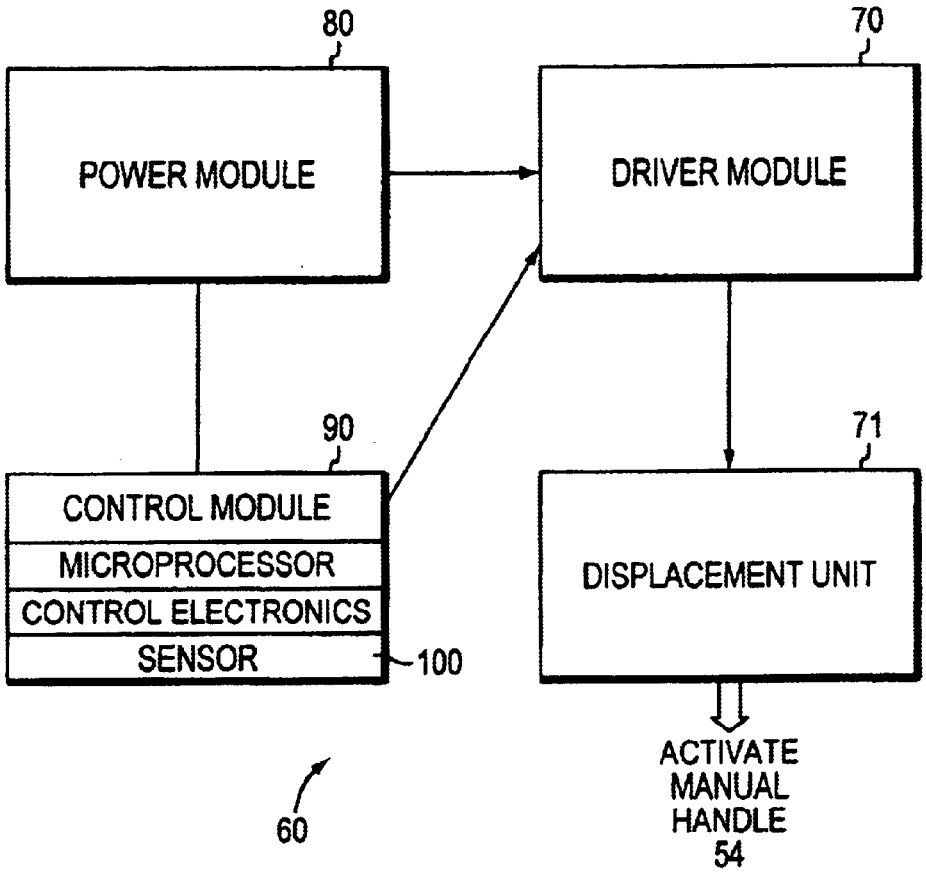
FIG. 2A is a block diagram of a conversion system used for retrofitting a manual flush valve of FIG. 1.
Figure 3:
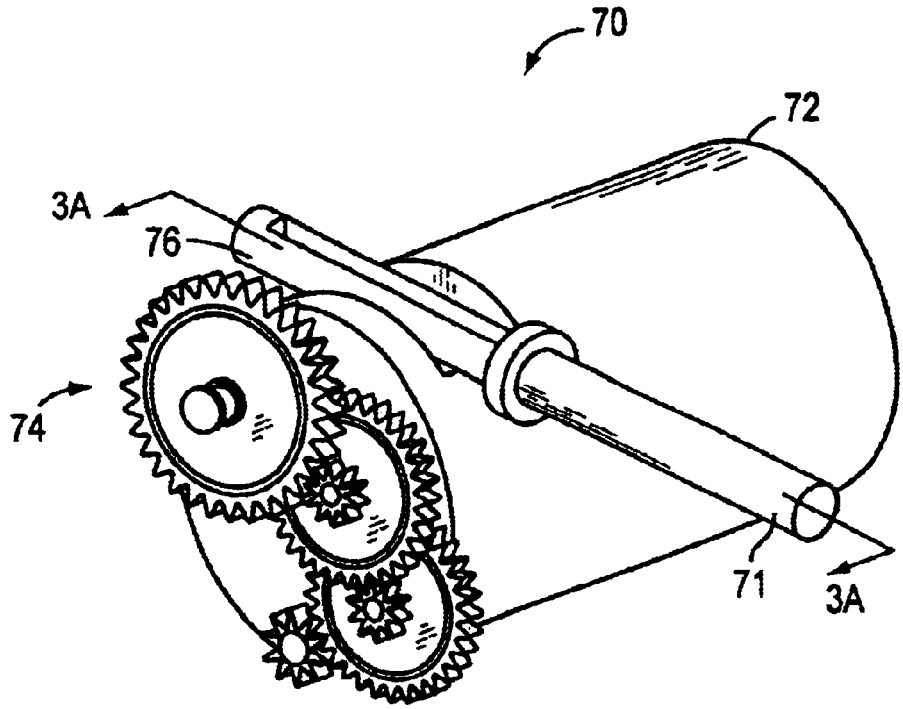
FIG. 3 is a perspective view of a driver module used in the conversion system shown in FIG. 2A.

Referring also to FIG. 2A, conversion system 60 includes a driver module 70, which is mechanically coupled to a displacement member 71, a power module 80 and a control module 90. All modules can be located in a single housing. Referring to FIG. 3, driver module 70 includes a motorized gear subassembly and an actuator mechanism subassembly, which are formed by a motor 72 connected to a gear assembly 74 coupled to a cam and spring arrangement 76 and displacement member 71. Displacement member 71 is arranged to externally activate the flush valve using valve handle 54 after receiving a signal from control module 90.

The motorized gear subassembly transfers electrical energy into mechanical motion through the set of gears 74 that increases the torque at the output, as explained below. Cam and spring arrangement 76 converts the torque into a downward motion. Mechanism 76 includes a preload spring (not shown) exhibiting a force slightly less than the force necessary to displace handle 54. The spring counterbalances the existing handle force and thereby reduces the energy needed to supply to driver module 70 to activate handle 54 automatically. After actuation, displacement member 71 pushes on flush handle 54 with a force slightly more than the net force (i.e., the difference of the existing handle force and the counterbalancing spring).

Motor 72 is preferably a DC motor having suitable torque and power consumption. Specifically, motor 72 may be the RF-370CH-13350 motor, or the RF-500TB-12560 motor, both made by Mabuchi. Both motors have a motor constant of about 17 mN m/A. The 370CH motor has a no load speed of about 2800 rpm and a stall torque of about 7.35 mN.m at 6V. The 500TB motor has a no load speed of 2200 and a stall torque of 5.88 mN.m at 6V. Although the 370CH motor is a little stronger, faster and has a slim body, the 500TB motor is shorter and consumes less current.

Figure 3A:
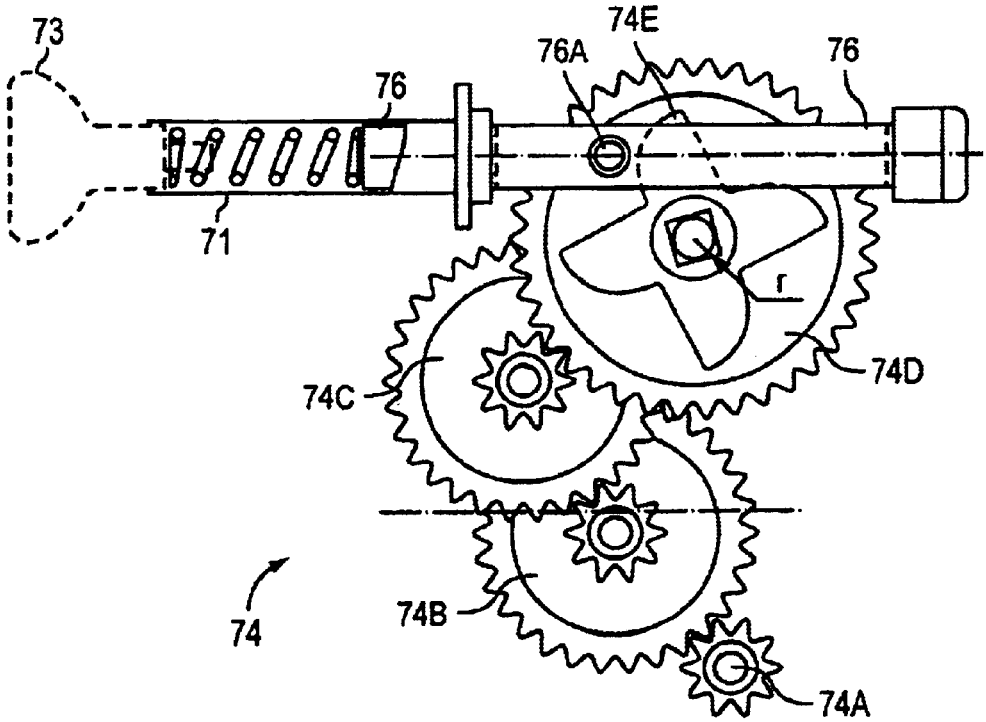
FIG. 3A is a cross-sectional view of a driver module shown in FIG. 3 along lines 3A—3A.

Referring also to FIG. 3A, the actuator mechanism subassembly uses a cam and spring arrangement 76 coupled to gear arrangement 74. The motor shaft rotates cogwheel 74A coupled to a cogwheel 74B, which is coupled to a cogwheel 74C, which in turn is coupled to cogwheel 74D. This set of gears (i.e., gear arrangement 74) increases the torque at the output formed by cam 76. In this arrangement wheel 74E pushes on pin 76A in one direction to displace displacement member 71, which in turn displaces plunger 56. Pin 76A and wheel 74E are located within a slot inside of the rod associated with cam 76. Wheel 74E is shaped for properly applying the torque on pin 76A and enabling pin 76A to move in the reverse direction under the force of the spring.

Preferably, gear arrangement 74 has a relatively large diameter that reduces stress on the shaft gear teeth. The larger shaft gear diameter to transmission gear diameter allows for a thicker shaft. The keyed shaft is designed such that both the molded shaft gear and the cam can simply be slid onto the shaft. Displacement element 71 includes a distal attachment 73 having a shape complementary to the shape of manual handle 54. Upon extension, displacement member 71 provides a typical combined force (including the preload spring) required to push the manual handle (direction of arrow A), which force is about 5 pounds (the required force for ADA compliance). This mechanism is energy efficient in order to extend the battery life to a maximum. The flush can be actuated within a relatively short time of a sensing event and has to be able to repeat every 10 seconds.

As mentioned above, the motorized gear subassembly moves only in one direction. The coupling between the motorized gear subassembly and the actuator mechanism subassembly is such that it enables displacement member 71 to travel downwards and permits said mechanism to be retracted by the forces that exist in the manual handle. The use of a cam in this mode of operation eliminates the need for motor rotation reversal, thereby further reducing energy consumption by simplifying the electronic drive circuitry.

The actuator subassembly includes a section that detects the end of the full stroke on the actuator mechanism and feeds this back to the electronics to stop the rotation of the motorized gear subassembly such that upon stopping of the rotation enough mechanical timing is allowed for the actuator mechanism subassembly to be retracted to its original position. The detection is achieved preferably by sensing the current or voltage changes in the motor driver power. Alternatively, the system can use other sensors measuring position, pressure, timing, etc. For example, the detection is achieved by a secondary sensory mechanism that detects either the position of the actuator mechanism subassembly or the position of the last gear that acts on the actuator mechanism subassembly.

Preferably, power module 80 is battery operated, wherein the batteries are mounted inside the main body of conversion system 60. The overall arrangement of system 60 provides an easy access to the batteries for convenient replacement. Power module 80 can include 4 "C" size batteries, which provide a voltage between 6.3 volts at the beginning of their life down to 4 volts at the end of their life. Alternatively, power module may be powered from an AC supply. The control module 90 includes control electronics, a microprocessor, and a sensor for detecting presence of an object, or for detecting movement. The sensor may be an optical sensor or an ultrasonic sensor. Preferably, the optical sensor is an infra-red sensor operating at a wavelength of about 940 nm.

Figure 4:
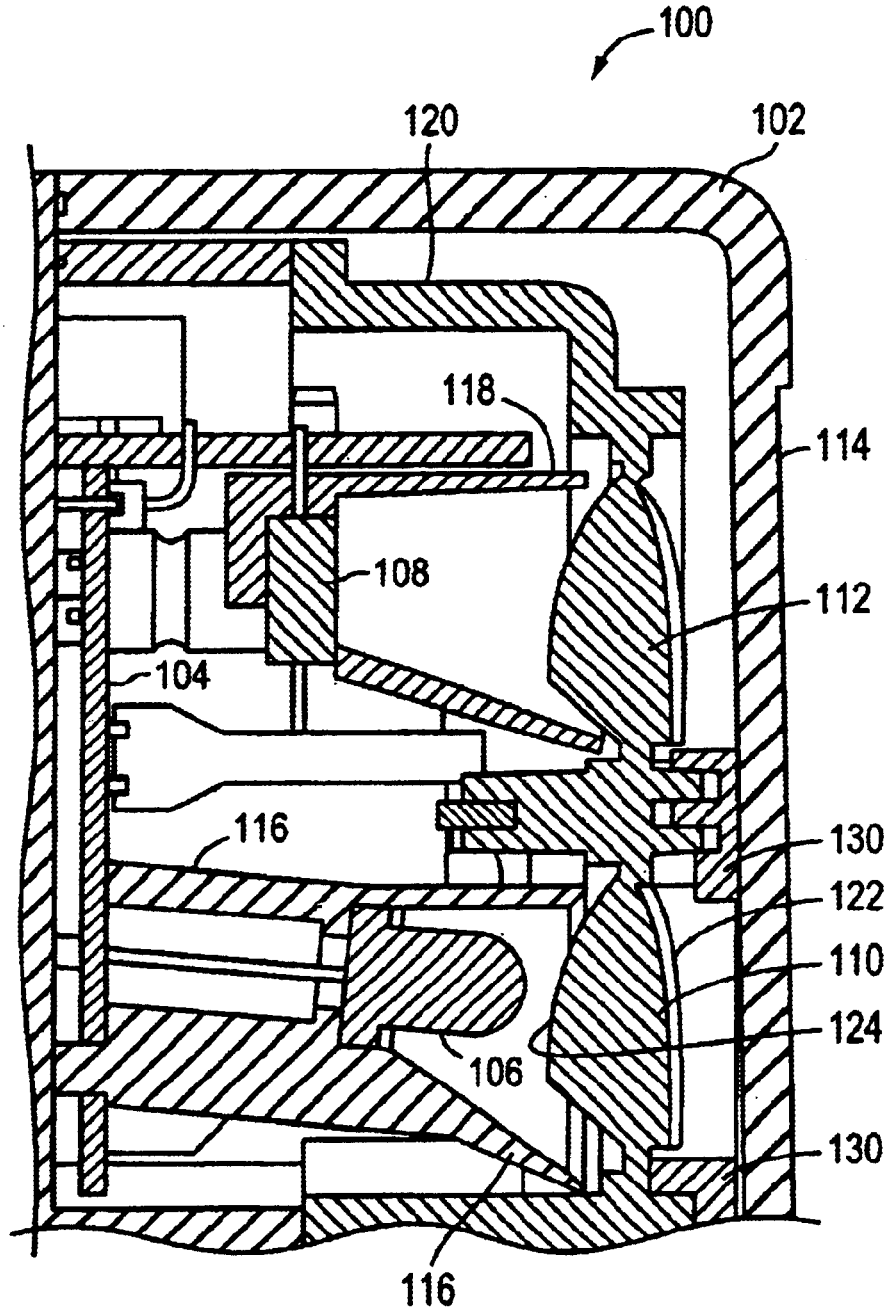
FIG. 4 shows schematically optical sensor used in the conversion system shown in FIG. 2A.

Referring to FIG. 4, optical sensor 100 includes a sensor circuit board 104, a light-emitting diode 106, the photodiode 108, a transmitter-lens 110, and a receiver lens 112, all located in a housing 102. Both light-emitting diode 106 and photodiode 108 are mounted on circuit board 104, wherein light-emitting diode 106 is located within a transmitter hood 116 and photodiode 108 is located within a receiver hood 118. Transmitter and receiver hoods 116 and 118 are opaque and tend to reduce noise and cross talk. Both hoods 116 and 118 are located at an infrared-transparent window 114 included in housing 102. Lenses 110 and 112 may be manufactured as a part of a front housing 120, located inside housing 102, using transparent material such as Lexan OQ2720 polycarbonate. Lens 110 has front and rear polished surfaces 122 and 124, respectively.

In the embodiment of FIG. 4, transmitter and receiver lenses 110 and 112 are formed integrally as part of the housing, which affords manufacturing advantages over arrangements in which the lenses are provided separately from the housing. However, in other embodiments, the lenses may be separate, which affords greater flexibility in material selection for both the lens and the circuit housing.

Figure 5:
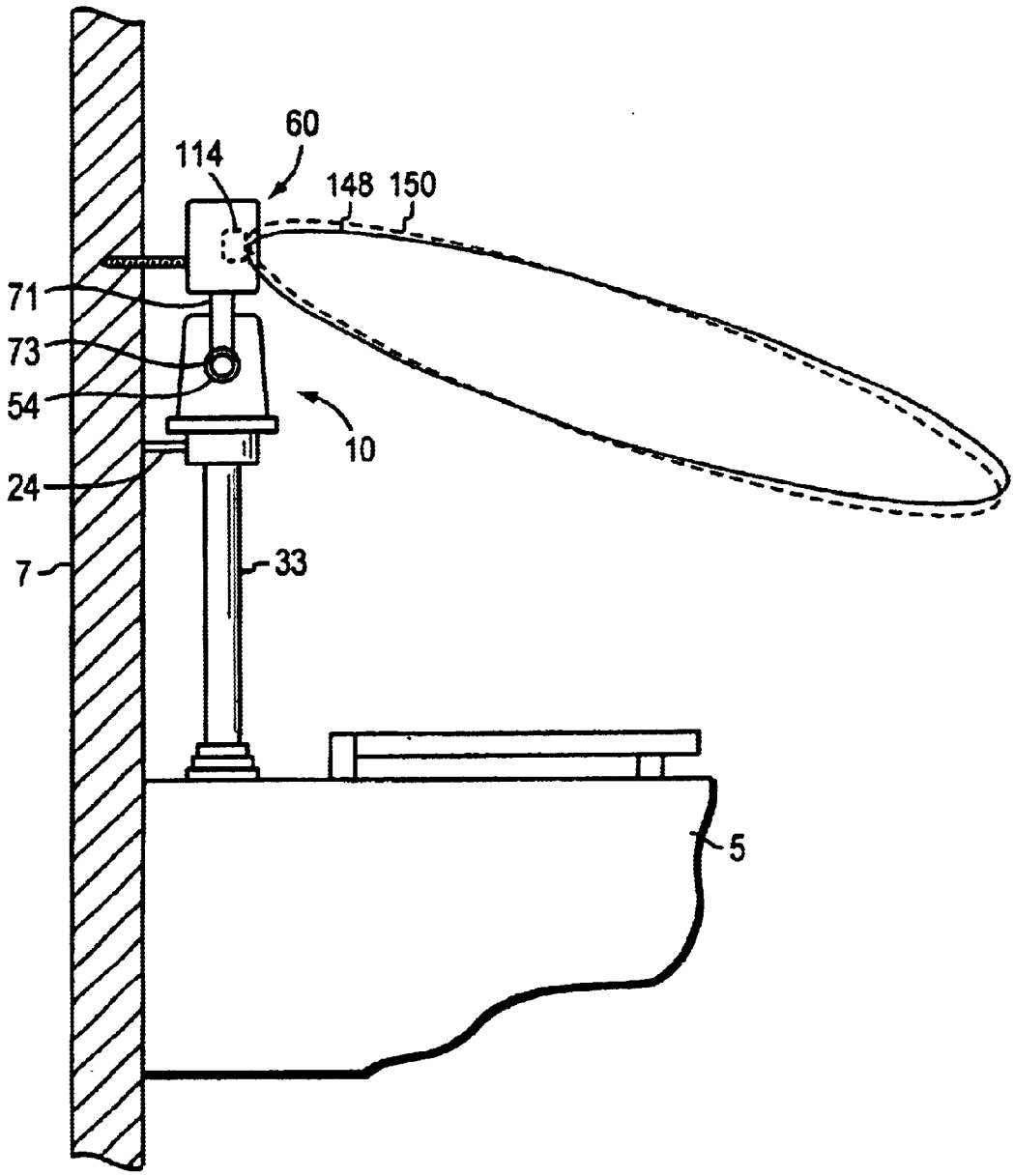
FIG. 5 is a side view of a toilet with the conversion system shown in FIG. 2A mounted on the wall.

Transmitter-lens 110 focuses infrared light from light-emitting diode 106 through infrared-transparent window 114 having a selected radiation-power distribution. Receiver lens 112 focuses received light onto photodiode 108, wherein this arrangement provides a selected pattern of sensitivity to light reflected from different targets. The emitted radiation-power distribution and the sensitivity pattern of photodiode 108 are shown in FIG. 5. Optical sensor 100 also includes an opaque blinder 130 mounted in front of lens 110 to form a central aperture for infra-red light transmission from the light-emitting diode 106, and to block stray transmission that could contribute to crosstalk. To prevent crosstalk, the optical sensor may include opaque stops and other elements.

FIG. 5 is a side view of a toilet 5 with a flush valve 10 retrofitted using conversion system 60. The body of conversion system 60 is mounted on a vertical wall 7, which also supports flush valve 10 by water input valve 24. Conversion system 60 includes a displacement member 71 mechanically coupled to handle 54 of flush valve 10. Optical sensor 100 emits an infrared transmission pattern 148 and detects detection pattern 150. Optical sensor 100 may use transmission and detection patterns described in U.S. Pat. No. 6,212,697, which is incorporated by reference as if fully reproduced herein.

When a person using toilet 5 leaves the irradiated area, optical sensor 100 triggers driver module 70, which in turn moves displacement member 71 to activate manual handle 54. Upon activation of manual handle 54, valve 10 enables water flow from input pipe 24 to output pipe 33. The user can also manually flush toilet 5 by depressing flush handle 54, as done prior to retrofitting valve 10. The ability to operate manually flush handle 54 is a useful feature of the conversion system that still enables manual use of Flushometer in case of electronic failure or complete power loss.

Figure 5A:
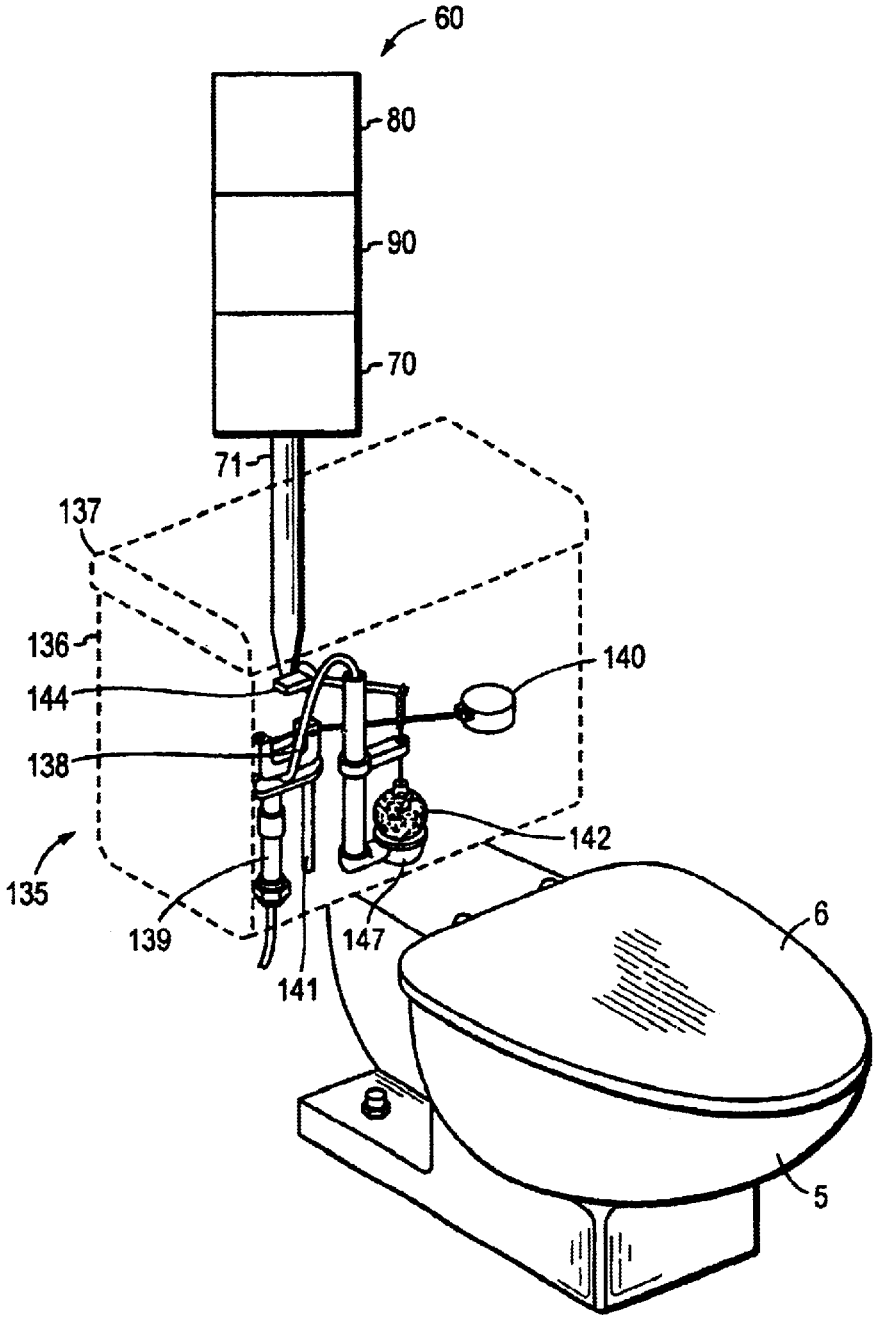
FIG. 5A is a partially perspective and partially diagrammatic view of another embodiment suitable for converting a water tank flush system.

Referring to FIG. 5A, conversion system 60 is also suitable for other types of flushing systems such as the water tank flush system. Conversion system 60 may be mounted externally onto the water tank, on an adjacent wall surface, on the cover of the water tank, inside the water tank cover, or to any other fixed member located near the manual flush handle. FIG. 5A shows only schematically the conversion system 60 without limiting it to any specific geometric arrangement or coupling.

According to other embodiments, conversion system 60 is also suitable for actuating manual flushing systems described in U.S. Pat. No. 6,263,519; and U.S. patent applications Ser. Nos. 09/716,870; 09/761,533; and 09/761,408 all of which are incorporated by reference for all purposes. In these embodiments, the displacement member actuates the manual actuator of the installed flush system (described in the above patent documents) to start the flush cycle.

The flush toilet system 135 includes a flush water tank 136 closed by cover 137, a float operated intake valve 138 connected to a float 140, and a ball valve 142 connected to a manual flush handle 144. Water from water tank 136 is discharged into toilet bowl 5 covered by a cover 6. Flush toilet system 135 also includes intake valve 138 mounted at the upper end of a water intake pipe 139 and has an outlet 141 into tank 136. Intake valve 138 is connected by a rod to float 140. Float 140 acts to close intake valve 138 when there is a certain water level in tank 136. To flush manually toilet 5, a user presses on a manual handle 144, which opens ball valve 142. Water is then discharged through a tank outlet fixture 147 into toilet 5.

Conversion system 60 is preferably mounted externally onto a flush water tank 136, on cover 137. Conversion system 60 may also be incorporated into a replacement cover that is installed instead of cover 137. This embodiment may be implemented by providing a coupling between flush handle 144 and displacement member 71, or by another coupling between displacement member 71 and valve 142 (which doesn't have to be a ball valve). In the embodiment of FIG. 5, due to the arrangement of the water tank flush system, an active part of the flush system (such as handle 144) can be removed and easily replaced without closing the water supply. The retrofitted system also enables a truly manual flush as the embodiment of FIG. 5.

In the embodiments of FIGS. 2, 5 or 5A, optical sensor 100 provides a trigger signal to control module 90. Light-emitting diode 106 and photodiode 108, and their respective enclosures described above, are arranged to emit and detect the transmission pattern and the detection pattern, respectively, as described, for example, in U.S. Pat. No. 6,212,697. The sensory field may be arranged near the centerline of the urinal or closet valve body with the emitted and received beams lined in vertical position so as to provide the maximum detection zone and not be blocked by closet seats that are in the lifted position. Further the sensor beams are aimed downwards to achieve maximum rejection of stationary targets such as walls and doors.

Upon valid target detection through the sensory electronics located on circuit board 104, motor 74 is activated and gear assembly pushes on the pre-existing flush handle by one of several means such as a cam preferably in a downward motion. The downward direction further permits the actual handle (which may protrude beyond the device) to be operated manually thereby letting the Flushometer to be used as a manual Flushometer, in case of electronic failure or power loss.

The housing of conversion system 60 is designed with respect of the type of attachment used with respect to the manual Flushometer. The housing may be anchored to the main body of the Flushometer at the manual handle mount structure prior to the handle or retaining nut. (See FIG. 1) This provides minimal disturbance to the overall envelope of the existing Flushometer and permits the installation of the device to all possible places including handicapped bathrooms. The housing may have a symmetric design for mounting on Flushometer valves having manual handle 54 protruding to the left or the right (and similarly for the water tank flush valves).

An alternative mechanism for the manual operation of the Flushometer may include a mechanical push button mounted on the top of the structure that surrounds the existing manual handle. The button is designed to directly push on handle 54 to provide a downward motion. Furthermore, the button is preferably loaded with a return spring mechanism to bring it back to its original position.

Figure 6:
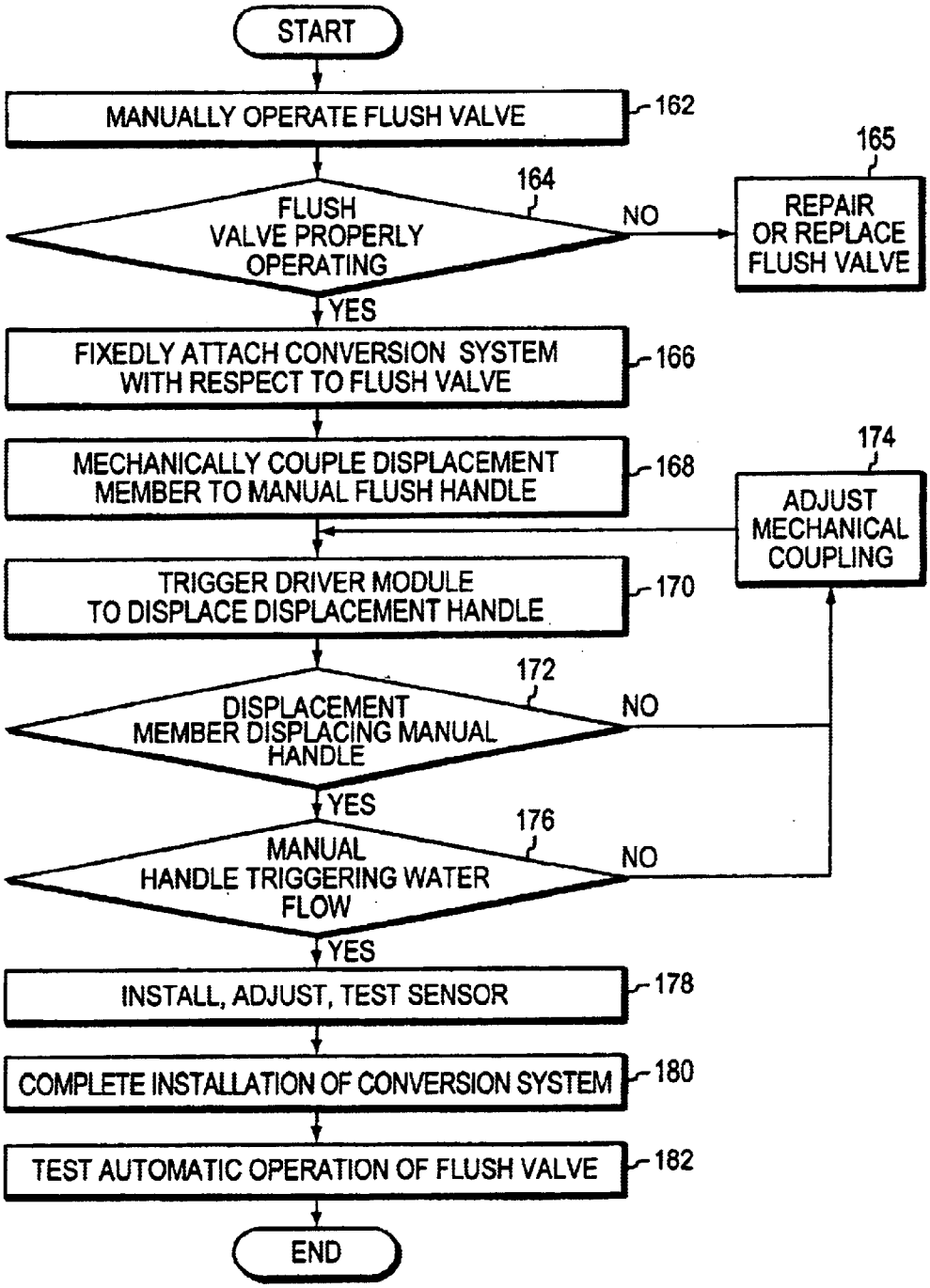
FIG. 6 is a flow diagram of a conversion process used to install the conversion system shown in FIG. 2A.

Referring to FIG. 6, relatively unskilled personnel can use conversion system 60 to convert an installed, manually operated flush valve. The conversion process starts with manually operating flush valve 10 to flush a urinal or toilet (step 162). If flush valve 10 does not operate properly, the valve has to be repaired or replaced (step 165). If flush valve 10 operates properly, the person fixedly attaches the body of conversion system 60 to a fixed surface (step 166). Conversion system 60 may include a variety of attachments for mounting the housing on different surfaces of flush valve 10, or on a wall surface.

The person then couples displacement member 71 to manual flush handle 54 (step 168). Next, the driver module is triggered by a test switch or by triggering optical sensor module 100 (step 170). After triggering driver module 70, the displacement member 71 activates manual handle 54 (step 170). If displacement member 71 does not activate manual handle 54, the person has to adjust the mechanical coupling between displacement member 71 and manual handle 54. (step 174). If manual handle 54 is displaced, but it does not cause water flow, displacement member 71 and driver module 70 may need to be adjusted. These adjustments are possible, but do not need to be performed in most cases. That is, in conversion system 60, the housing and the attachments are constructed so that after mounting the housing and coupling displacement member 71 to manual flush handle 54, no mechanical adjustments are needed in most cases. If there is water flow, the person can install or adjust position of optical sensor 100 to obtain desired transmission and detection fields. (step 178). The person then completes the installation of conversion system 60, and again tests automatic operation of the flush valve (step 182).

Having described various embodiments and implementations of the present invention, it should be apparent to those skilled in the relevant art that the foregoing is illustrative only and not limiting, having been presented by way of example only. There are other embodiments or elements suitable for the above-described embodiments, described in the above-listed publications, all of which are incorporated by reference as if fully reproduced herein. The functions of any one element may be carried out in various ways in alternative embodiments. Also, the functions of several elements may, in alternative embodiments, be carried out by fewer elements, or a single, element.

What is claimed is:

1. A method for converting a manually operated flush valve used with a urinal or toilet, comprising the acts of:

providing a manually operated flush valve including a valve mechanism located within a valve body constructed and arranged to control water flow between a water inlet and a water outlet, a manual handle mechanically coupled to said valve mechanism and constructed to operate said valve mechanism upon pivotable displacement;

manually causing pivotable displacement of said manual handle and thereby causing water flow between said water inlet and said water outlet;

after said manually causing pivotable displacement, providing a conversion assembly including a power module, a control module, a driver module, including a gear assembly and a spring, and a displacement member;

mounting fixedly said conversion assembly relative to said valve body;

providing a mechanical coupling between said displacement member and said handle including preloading said spring;

actuating said control module and thereby triggering said driver module acting on said gear assembly constructed to displace said displacement member; and pivotably displacing said manual handle by said displacement member to actuate said valve mechanism and cause water flow between said water inlet and said water outlet.

2. The method of claim 1 wherein said acts of mounting and positioning are performed without breaking a water seal of said flush valve.

3. The method of claim 1 performed without closing a water supply to said water inlet.

4. The method of claim 1 performed without disassembling any part of said manually operated flush valve.

5. The method of claim 1 further including manually displacing said manually operated handle.

6. The method of claim 1 further including manually displacing by hand touching said manually operated handle.

7. The method of claim 1 wherein said displacement member performing a substantially linear motion when displacing said manual handle to actuate said valve mechanism.

8. The method of claim 1 wherein said displacement member performing a substantially rotational motion when displacing said manual handle to actuate said valve mechanism.

9. The method of claim 1 wherein said fixedly mounting said conversion assembly relative to said valve body includes attaching said conversion assembly directly onto said valve body.

10. The method of claim 1 wherein said fixedly mounting said conversion assembly with respect to said valve body includes attaching said conversion assembly on a wall near said valve body.

11. The method of claim 1 wherein said fixedly mounting said conversion assembly with respect to said valve body includes attaching said conversion assembly on a stationary surface near said valve body.

12. The method of claim 1 wherein said displacement member includes a linear structure having a proximal region coupled to said gear mechanism and a distal end shaped to provide contact with said manual handle during said pivotably displacing.

13. The method of claim 1 wherein said valve mechanism includes a diaphragm-type mechanism.

14. The method of claim 1 wherein said valve mechanism includes a piston-type mechanism.

15. The method of claim 1 wherein said actuating said control module includes using a sensor.

16. The method of claim 1 wherein said actuating said control module includes using an infrared sensor.

17. The method of claim 1 wherein said actuating said control module includes using a presence sensor.

18. The method of claim 1 wherein said actuating said control module includes using a motion sensor.

19. A method for converting a manually operated flush valve used with a urinal or toilet, comprising the acts of:

providing a manually operated flush valve including a valve mechanism located within a valve body constructed and arranged to control water flow between a water inlet and a water outlet, a manual handle mechanically coupled to said valve mechanism and constructed to operate said valve mechanism;

manually displacing said manual handle and thereby causing water flow between said water inlet and said water outlet;

providing a conversion assembly including a power module, a control module including a sensor, and a driver module, including a gear assembly and a spring, coupled to a mechanical actuator;

mounting fixedly said conversion assembly relative to said valve body;

positioning a mechanical actuator coupled to said driver module relative to said manual handle including preloading said spring;

actuating said control module by a signal from said sensor and thereby actuating said driver module and said gear assembly constructed to displace said mechanical actuator; and displacing said manual handle by action of said mechanical actuator to actuate said valve mechanism and cause water flow between said water inlet and said water outlet.

20. The method of claim 19 further including manually displacing said manually operated handle.

21. The method of claim 19 further including manually displacing by hand touching said manually operated handle.

22. The method of claim 19 wherein said acts of mounting and positioning are performed without breaking a water seal of said flush valve.

23. The method of claim 19 performed without closing a water supply to said water inlet.

24. The method of claim 19 performed without disassembling any part of said manually operated flush valve.

25. The method of claim 19 wherein said positioning said mechanical actuator coupling includes connecting said mechanical actuator to said manually operated handle using a displacement member.

26. The method of claim 19 wherein said mechanical actuator performs a substantially linear motion when actuated.

27. The method of claim 19 wherein said mechanical actuator performs a substantially rotational motion when actuated.

28. The method of claim 19 wherein said mechanical actuator performs a rotational and linear motion when actuated.

29. The method of claim 19 wherein said fixedly mounting said conversion assembly relative to said valve body includes attaching said conversion assembly directly onto said valve body.

30. The method of claim 19 wherein said fixedly mounting said conversion assembly with respect to said valve body includes attaching said conversion assembly on a wall near said valve body.

31. The method of claim 19 wherein said fixedly mounting said conversion assembly with respect to said valve body includes attaching said conversion assembly on a stationary surface near said valve body.

32. The method of claim 19 wherein said valve mechanism includes a diaphragm-type mechanism.

33. The method of claim 19 wherein said valve mechanism includes a piston-type mechanism.

34. The method of claim 19 wherein said sensor includes an optical sensor.

35. The method of claim 34 wherein said sensor includes an infrared sensor.

36. The method of claim 34 wherein said sensor includes a presence sensor.

37. The method of claim 34 wherein said optical sensor includes a motion sensor.

38. The method of claim 34 wherein said actuating said control module includes using battery power from said power module.

39. A conversion system for converting an installed manually-operated flush valve used with a urinal or toilet, comprising: a power module, a control module, and a driver module arranged for mechanical coupling to a manual handle of said manually-operated flush valve, wherein said driver module includes a gear mechanism mechanically coupled to a spring loaded displacement member having a proximal region coupled to said gear mechanism and a distal end shaped to provide contact with said manual handle for automatic actuation controlled by said control module, said conversion system allowing manual actuation of said handle for manually operating said flush valve.

40. A conversion system for converting an installed manually-operated flush valve used with a urinal or toilet, comprising: a power module, a control module, and a driver module arranged for mechanical coupling to a manual handle of said manually-operated flush valve, said mechanical coupling enabling automatic actuation controlled by said control module and manual actuation of said manual handle, wherein said power module includes a battery, and said driver module includes an electromotor, powered by said battery, and a gear assembly coupled to a displacement member utilizing a preloaded spring.

41. The conversion assembly of claim 40 wherein said displacement member is constructed and arranged to move linearly when acting on said manual handle.

42. The conversion assembly of claim 40 wherein said displacement member is constructed and arranged to rotate when acting on said manual handle.

43. The conversion assembly of claim 40 wherein said displacement member is constructed and arranged to perform a combined linear and rotational motion when acting on said manual handle.

44. The conversion assembly of claim 40 wherein said displacement member is constructed and arranged to perform linear motion when acting on said manual handle.

45. A conversion system for converting an installed manually-operated flush valve used with a urinal or toilet, comprising: a power module, a control module, and a driver module, including a gear assembly and a preloaded spring, arranged for mechanical coupling to a manual handle of said manually-operated flush valve for automatic actuation controlled by said control module, wherein said manually operated flush valve includes a piston-type mechanism and said conversion system allowing manual actuation of said handle for manually operating said flush valve.

46. A conversion system for converting an installed manually-operated flush valve used with a urinal or toilet, comprising: a power module, a control module, and a driver module, including a gear assembly and a spring, arranged for mechanical coupling to a manual handle of said manually-operated flush valve for automatic actuation controlled by said control module, wherein said manually operated flush valve includes a diaphragm-type mechanism and said conversion system allowing manual actuation of said handle for manually operating said flush valve.

47. A conversion system for converting an installed manually-operated flush valve used with a urinal or toilet, comprising an externally mounted conversion assembly including a power module, a control module including a sensor, and a driver module mechanically coupled to a displacement member arranged to externally activate said manually-operated flush valve acting by a preloaded spring arrangement on a manual valve handle for automatic actuation controlled by said control module, wherein said driver module includes a gear mechanism coupled to said displacement member constructed to enable manual actuation of said handle for manually operating said flush valve.

48. A conversion system for converting an installed manually-operated flush valve used with a urinal or toilet, comprising an externally mounted conversion assembly including a power module, a control module including a sensor, and a driver module, including a gear assembly and a preloaded spring, mechanically coupled to a displacement member arranged to externally activate said manually-operated flush valve using a manual valve handle for automatic actuation controlled by said control module, wherein said displacement member is constructed and arranged to rotate when acting upon said manual valve handle while allowing manual actuation of said handle for manually operating said flush valve.

49. A conversion system for converting an installed manually-operated flush valve used with a urinal or toilet, comprising an externally mounted conversion assembly including a power module, a control module including a sensor, and a driver module, including a gear assembly and a preloaded spring, mechanically coupled to a displacement member arranged to externally activate said manually-operated flush valve using a manual valve handle for automatic actuation controlled by said control module, wherein said displacement member is constructed and arranged to pivotably displace said manual valve handle while allowing manual actuation of said handle for manually operating said flush valve.

50. The conversion assembly of claim 47, 48 or 49 wherein said manually-operated flush valve includes a diaphragm-type valve mechanism.

51. The conversion assembly of claim 47, 48 or 49 wherein said manually-operated flush valve includes a piston-type valve mechanism.

52. The conversion assembly of claim 47, 48 or 49 wherein said sensor is an ultrasonic sensor.

53. The conversion assembly of claim 47, 48 or 49 wherein said sensor is an optical sensor.

* * * * *